United States Patent [19]

Hankel

[11] Patent Number: 4,529,637

[45] Date of Patent: Jul. 16, 1985

[54] ACOUSTICAL MATERIAL

[76] Inventor: Keith M. Hankel, 4773 Shaunee Creek Dr., Dayton, Ohio 45415

[21] Appl. No.: 527,434

[22] Filed: Aug. 24, 1983

[51] Int. Cl.[3] ..... B32B 3/14

[52] U.S. Cl. ..... 428/49; 428/119; 428/131; 181/286

[58] Field of Search ..... 428/119, 131, 49; 181/286

[56] References Cited

U.S. PATENT DOCUMENTS

| | | | |
|---|---|---|---|
| 3,997,492 | 8/1976 | Hankel | 181/336 |
| 4,001,473 | 1/1977 | Cook | 428/131 |
| 4,077,491 | 3/1978 | Hankel | 181/290 |
| 4,291,080 | 9/1981 | Ely et al. | 428/131 |
| 4,292,356 | 9/1981 | Whitemore et al. | 428/116 |
| 4,293,465 | 8/1981 | Morimoto et al. | 428/566 |

OTHER PUBLICATIONS

*Basic Principles of Photo Chemical Machining,* Technical Profile No. PCMI-G-100, Jun. 1976, Photo Chemical Machining Institute, 1717 Howard Street, Evanston, Illinois 60202.

*Primary Examiner*—Bernard Lipman

*Attorney, Agent, or Firm*—Biebel, French & Nauman

[57] ABSTRACT

The disclosure is directed broadly to a thin metal sheet containing a multitude of small openings therethrough. Typically, the sheet will contain at least 400 openings per square inch with the openings having an average cross-sectional area of from about 0.0005 to about 0.005 square inch. The sheets are used to overlay a series of perpendicularly aligned walls which define air chamber(s) behind the sheet. Sound waves pass through the porous sheet and are absorbed in the air chamber(s).

6 Claims, 11 Drawing Figures

ACOUSTICAL MATERIAL

BACKGROUND OF THE INVENTION

The invention relates generally to sound absorbent material. In a particular embodiment, it relates to a thin, porous metal sheet which, when used with an air space, functions as a sound absorbent material for industrial applications.

Recently, increased attention has been focused on noise pollution, including that generated by the use of machinery, such as drills, lathes and the like. Noise is a problem to the operator of the machine, as well as to those in the area where the machine is being operated. As a result, efforts have and are being made to prevent or to reduce the noise level of machinery in order to provide a safer, quieter work area.

Attempts have been made to silence or to reduce machine noise by lining the inside of the machine, or housing surrounding the machine, with a material which will soak up or reduce the noise. It is important that the sound absorbent material be relatively inexpensive in addition to being an efficient and effective sound absorber. If the material is too expensive, the expense will make its use prohibitive even though it is efficient and effective, especially considering the number of machines which would use the material. Thus, an inexpensive material would find greater use, even where it was inefficient or would eventually become ineffective and have to be replaced, because of its low cost.

A typical lining material for machinery is open-cell polyurethane foam, which is a resistive sound absorber. It is a relatively inexpensive material, and it will reduce the noise level by providing a resistance to the passage of sound emanating from the machine. But, open-cell polyurethane foam has a tendency to soak up oil and the like used to lubricate the machine. Once the cells of the sound-absorbent foam material fill with oil, the material becomes noise reflective, and so is inefficient and ineffective. Further, the accumulated oil represents a fire hazard. Another sound absorbent material is the non-woven fiberglass pad which is similar to open-cell foam in its operation, and likewise becomes ineffective and/or hazardous due to oil absorption.

Other sound absorbing materials and structures are known in the art, but these materials are too sophisticated, too complicated and/or too expensive. Often the construction materials are expensive, ineffective, inefficient or hazardous, such as with paper, wood or asphalt materials. Such structures are not necessarily inoperative, as they are useful for general acoustical applications, but they are not useful in association with noise generating machinery.

SUMMARY OF THE INVENTION

The acoustical system of the invention broadly comprises a planar thin metal sheet containing a multitude of small openings therethrough. The sheet is used to overlay a series of perpendicularly aligned walls which define air chamber(s) behind the sheet. Sound waves pass through the porous sheet and are absorbed in the air chamber(s).

The metal sheet, which can be fabricated from essentially any metal, such as steel, copper, aluminum or preferably stainless steel, is relatively thin and customarily has a thickness in the range of about 1–100 mils, preferably about 3–15 mils, and most especially about 5 mils. The metal sheet contains a multitude of small openings therethrough, with the openings being distributed substantially uniformly over the sheet's entire surface. The number and size of the openings provided in the metal sheet are discussed infra. The number of the openings in the sheet and their cross-sectional areas are selected so that the metal sheet has an acoustical flow resistance in the range of about 10–300 rayls, preferably about 50–100 rayls, and more especially about 60–75 rayls.

The perpendicularly aligned walls used in conjunction with metal sheet serve two important functions. First, the walls provide support for the planar metal sheet. Second, the vertical walls, in conjunction with the metal sheet, define air chambers which absorb sound waves which pass through the porous metal sheet. The depth of the air chambers, fixed by the height of the vertical support walls, has a significant effect upon the sound absorbing characteristics of the system of the invention. Typically, the chambers will have a depth ranging from about 1 inch to about 12 inches. The detailed effect that the chamber depth has on the sound absorbing characteristics is described in greater detail infra. The walls will be arranged so as to define one or more air chambers per section of metal sheet, the precise number of air chambers to be provided per section of metal sheet being principally a matter of convenience in construction. Where multiple air chambers are provided, the air chambers preferably will be of uniform cross-sectional area and volume.

DETAILED DESCRIPTION OF THE INVENTION

Figure 1:
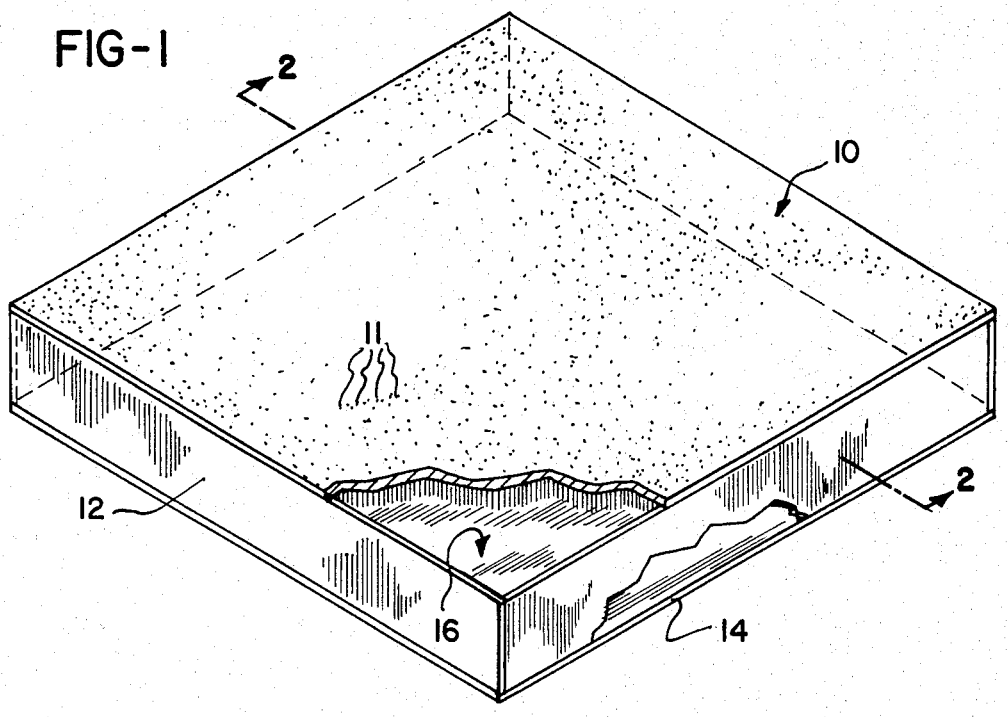
FIG. 1 is a perspective view, with the parts broken away, illustrating one embodiment of the invention which is an acoustical tile containing a single porous metal sheet and a single air chamber.

Referring to FIG. 1 of the drawings, an acoustical tile is shown which contains a thin, porous metal sheet 10, four wall sections 12 (only two of which are shown), and a bottom sheet 14. The porous sheet 10 contains a very large number of small openings 11, only a few of which are shown. The support walls 12 typically will be 1 to 12 inches in height and will have a length of convenient size, typically 8 to 12 inches. The bottom sheet 14 does not constitute an essential functional element of the construction and is provided principally to provide rigidity to the structure and to serve as a convenient surface for attaching the tile to a wall or like surface. Both sheets 10 and 14 will be approximately 5 mils thick, with sheet 14 being fabricated from any convenient material such as metal, paper or plastic. The sheets 10 and 14 and the sidewalls 12 define an air chamber 16. The number of openings 11 and the cross-sectional areas of the openings are such that sheet 10 has a preselected acoustical flow resistance, typically about 65 rayls.

Figure 2:
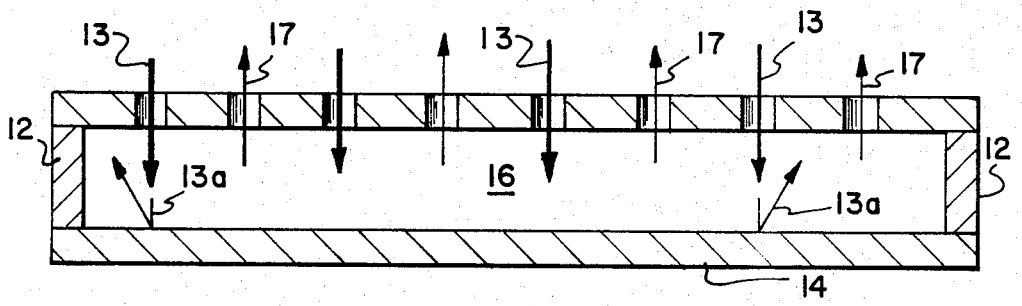
FIG. 2 is a sectional view of the tile of FIG. 1 taken through line 2—2 of FIG. 1.

FIG. 2 illustrates the mechanism which effects the sound absorption in the acoustical system of the invention. The arrows 13 represent sound waves traveling in a plane normal to porous facing sheet 10 which pass through openings 11 to enter air chamber 16. The arrows 13*a* indicate that when the sound waves contact the surface of sheet 14 they are scattered in various directions and are diffused throughout air chamber 16. A finite percentage of the sound waves entering air chamber 16 are reflected out of the air chamber 16 as noted by arrows 17. The volume of sound waves absorbed by air chamber 16 divided by the volume of sound waves entering the chamber is expressed as an absorption coefficient as discussed infra.

Figure 3:
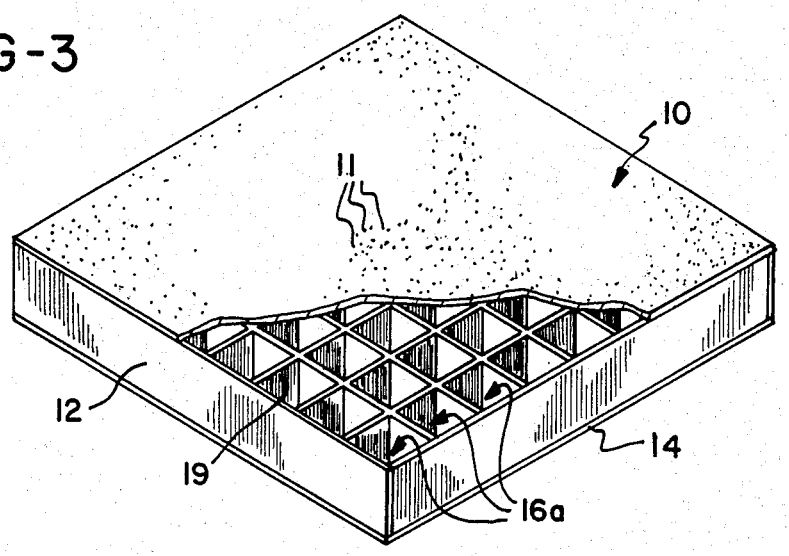
FIG. 3 is a perspective view of an acoustical tile similar to that shown in FIG. 1, but one in which multiple air chambers are provided in the tile.

The embodiment of the invention illustrated in FIG. 3 differs from that in FIG. 1 in that a vertically aligned honeycomb structure 19 is provided within the air chamber 16 to subdivide air chamber 16 into a series of smaller air chambers 16*a*.

Figure 4:
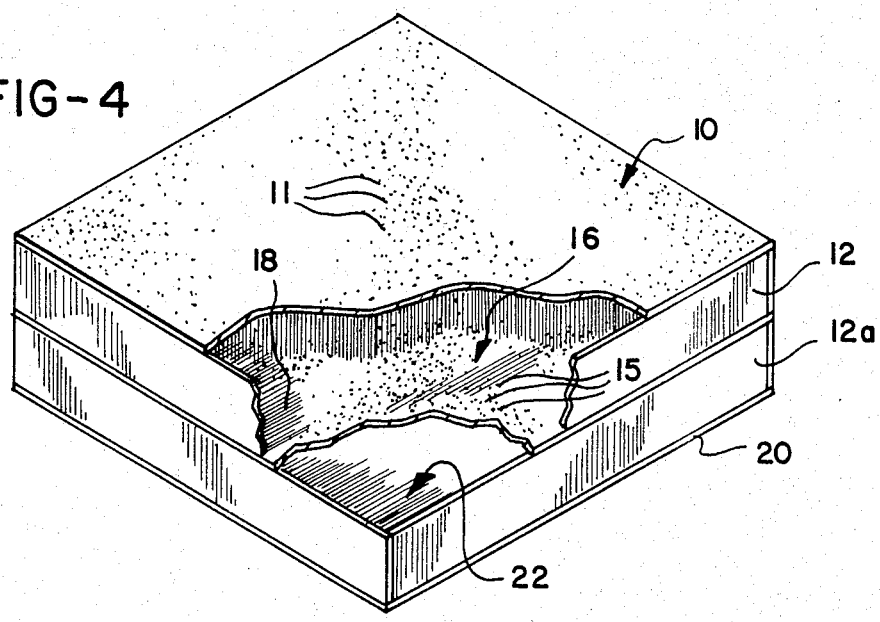
FIG. 4 is a perspective view with the parts broken away of another embodiment of the invention in which two parallel porous metal plates are provided in the tile, with one air chamber being provided between the two porous metal sheets and a second air chamber being provided between the second porous metal sheet and the bottom sheet of the tile.

FIG. 4 illustrates a more complex tile structure in which a second porous metal sheet 18 containing openings 15 is positioned in parallel relationship with porous sheet 10 and intermediate between porous sheet 10 and bottom sheet 20. In this embodiment of the invention, air chamber 16 is defined by porous sheet 10, porous sheet 18, and sidewalls 12. A second air chamber 22 is defined by porous sheet 18, bottom sheet 20 and sidewalls 12*a*. The height of sidewalls 12 and 12*a* may be different with sidwalls 12 typically being 4 inches in height and sidewalls 12*a* typically being 2 inches in height. By analogy to the mechanism previously described with respect to FIG. 2, it is readily recognized that sound waves passing through openings 15 in porous sheet 18 pass into air chamber 22 and are absorbed in substantial part therein.

Figure 10:
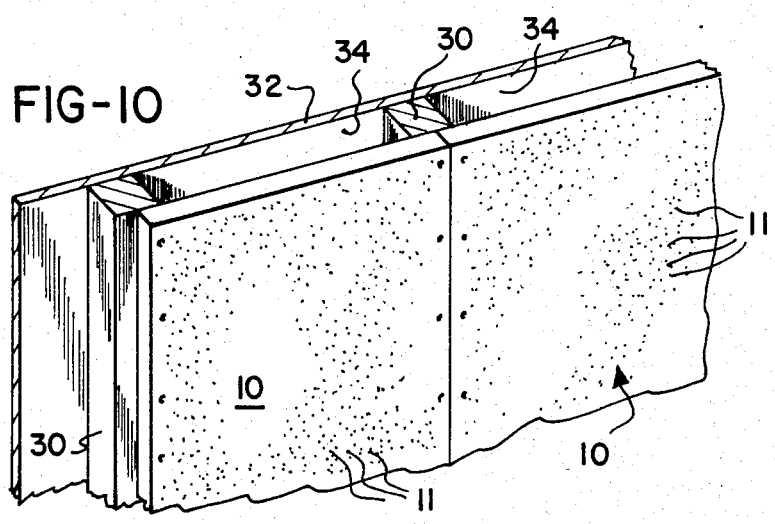
FIG. 10 is a perspective view of porous metal sheets of the invention being mounted on a wall with furring strips to function as a sound absorbing medium.

FIG. 10 illustrates the manner in which the porous metal sheet of the invention can be employed as a sound absorbing material for a vertical wall. Sheets 10 are nailed or otherwise attached to furring strips 30 mounted on wall 32. The furring strips 30, the porous sheets 10 and the wall 32 define a series of air chamber(s) 34 which absorb sound waves passing through sheets 10.

Figure 11:
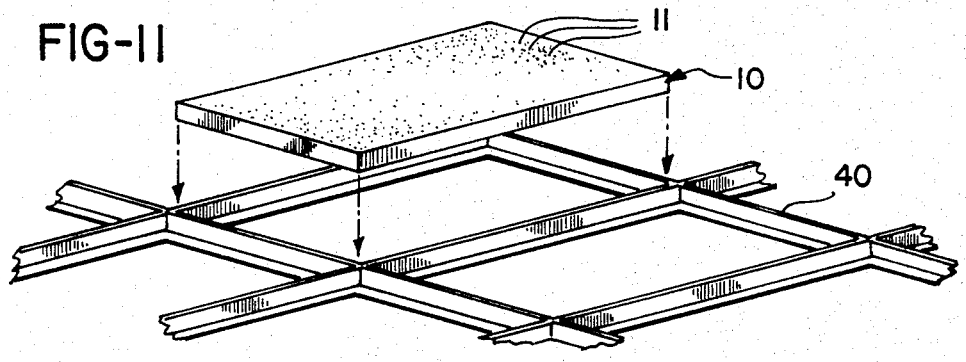
FIG. 11 is an exploded view illustrating the placement of a porous metal sheet of the invention in a fixture to function as an acoustical tile.

FIG. 11 illustrates the manner in which the porous sheets of the invention can be employed as acoustical ceiling tiles. The sheets 10, only one of which is shown, rest in the supporting arms of a ceiling support fixture 40 which is suspended from a ceiling by suitable support elements not shown. The air chamber defined by the ceiling, the sheets 10 and the upper sections of the room's vertical walls absorb sound waves passing through the openings in sheets 10.

The effectiveness of the acoustical system of the invention to absorb sound of a given frequency is controlled principally by two parameters of the system. The first parameter is the acoustical flow resistance of the porous metal sheet. The flow resistance is defined as the ratio of the pressure drop across the material to the velocity of air passing through it. This acoustical flow resistance is expressed in rayls (dynes-sec per $cm^2$). The second parameter is the depth of the air chamber provided on the underside of the porpous metal sheet, which for an air chamber of specified cross-sectional area also defines the air volume contained in the air chamber.

The acoustical flow resistance must be held within prescribed limits to develop maximum sound absorption. If the acoustical flow resistance is too high, sound waves cannot readily pass through the porous metal sheet. If the acoustical flow resistance is too low, the sound waves will pass through the porous sheet (in both directions) as if the sheet did not exist. When the acoustical flow resistance is within proper limits, and an air chamber is provided behind the porous metal sheet, the sound waves enter the air chamber through the porous metal sheet and the sound energy is dissipated in the air chamber.

The acoustical flow resistance of the porous metal sheet is controlled by three structural characteristics of the porous metal sheet. The first of these structural characteristics is the cross-sectional area of the openings provided in the metal sheet. These openings are quite small and typically range from about 0.0005 to 0.005 square inch, preferably 0.0009 to 0.003 square inch, and more especially about 0.001 to 0.002 square inch. The cross-sectional areas of the individual openings are not necessarily uniform throughout the sheet, and any values set forth will be understood to be average values for a large number of openings. Under ordinary circumstances, the cross-sectional areas of the openings will not vary substantially more than about ±50% from the average value of the openings. Typically 90% of the openings will fall within this range. The second structural characteristic is the actual number of openings provided per unit of area in the metal sheet. For openings of a specified size, the rayl value will be inversely proportional to the number of openings provided in the sheet. For sheets having openings of the cross-sectional area previously described, the porous metal sheets employed in the invention will contain at least about 400 openings per suare inch, preferably at least about 900 openings per square inch, and more especially at least about 1600 openings per square inch. The third structural characteristic of importance is that the openings must be distributed substantially uniformly over the sheet's entire surface, although not necessarily in a rigorously ordered pattern. It will be recognized, of course, that the three structural characteristics described are not mutually independent of each other. As will be readily recognized, to provide a porous sheet of a pre-selected rayl value, a larger number of openings must be provided when the average cross-sectional area of the openings is low than is the case when the openings have somewhat larger cross-sectional areas.

The length and width of the sheet are not critical to the operability of the invention. For convenience, however, the sheets should be of a size suitable for economical manufacture and ease of handling. It presently is preferred to employ 24"×60" sheets with a 5 mil thickness.

Figure 5:
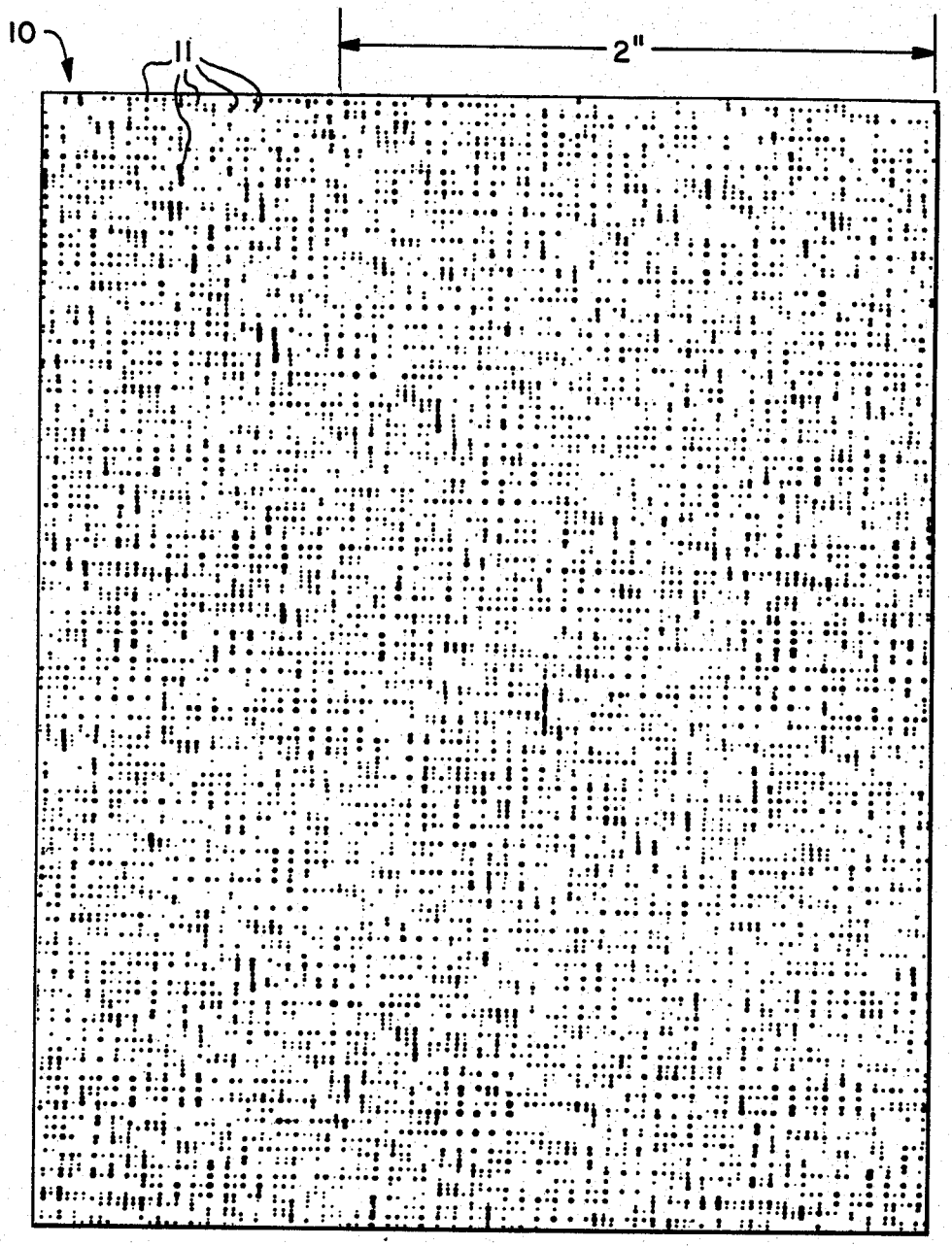
FIG. 5 is a plan view of a porous metal sheet of the invention indicating the number and cross-sectional areas of the openings provided in a typical porous metal sheet of the invention.

FIG. 5 is a plan view, at a 4× magnification, of a typical section of a porous sheet employed in the invention. As illustrated, the pores have an average cross-sectional area of less than about 0.001 square inch. Approximately 900 openings are provided per square inch of surface.

The second parameter which has an effect upon the ability of the acoustical system of the invention to absorb sound is the depth of the air chamber provided on the underside of the porous metal sheet. In constructing acoustical tiles having a single porous metal sheet of the type illustrated in FIGS. 1 and 3, it is preferred to provide air chamber depths from about 1 inch to about 12 inches. As will be discussed infra, the effectiveness of the acoustical tile to absorb sound of a given frequency will be a function of the depth of the underlying air chamber.

A stainless steel sheet 5 mils thick was prepared and had a rayl value of 65. The sheet was prepared so as to contain approximately 900 openings per square inch. The average cross-sectional area of the openings was about 0.001 square inch. The openings in the sheet were prepared by a photochemical machining technique (etching) following the general procedures set forth in the *Photochemical Machining Institute Technical Profile* published in June 1975 and identified as PCMI-G-100.

The normal incident absorption coefficients of the porous sheet prepared above were measured at several sound frequencies with an air chamber depth of 1 inch, 2 inches, and 4 inches following the procedures of ASTM Method C384-77. A second test was run employing two segments of the porous sheet prepared above. In this test, the depth of the air chamber provided between the two porous sheets was 4 inches with the depth of the second air chamber being 2 inches. The data obtained are plotted on a semi-log scale in FIGS. 6, 7, 8, and 9.

Figure 6:
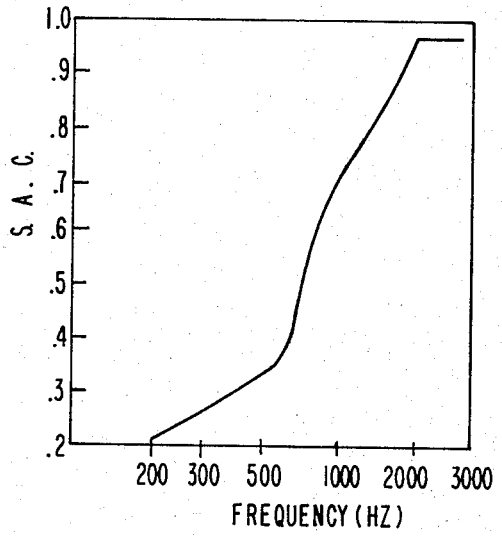

The curve in FIG. 6 was obtained with the system having an air chamber 1 inch deep. It will be noted that the sound absorption coefficient does not reach a value of 0.7 until the sound frequency reaches 1000 Hz. At higher frequencies, the sound absorption coefficient increases rapidly and reaches a value in excess of 0.95 at 2000 Hz.

Figure 7:
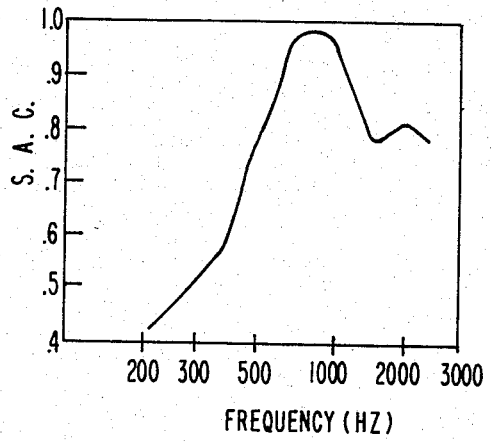

The curve in FIG. 7 was obtained with the system having an air chamber 2 inches deep. It is noted that the sound absorption coefficient at frequencies up to and including 1000 Hz is materially higher than for the system employing and air chamber 1 inch deep. At frequencies above 1500 Hz, the sound absorption coefficient is lower than the corresponding values for the system employing an air chamber 1 inch deep.

Figure 8:
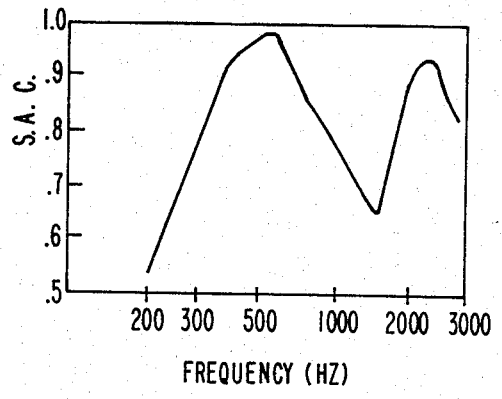
FIGS. 6 through 9 show a series of curves of sound absorption coefficients versus sound frequency for several tiles of the invention.

The curve in FIG. 8 was obtained with the system having an air chamber 4 inches deep. It is noted that the sound absorption coefficients at frequencies below about 400 Hz is materially higher than the corresponding values for the systems having an air chamber either 1 or 2 inches deep. At frequencies in the range of about 500 to about 3000 Hz, the sound absorption coefficient is somewhat lower than is the case for the systems having air chamber depths of 1 inch or 2 inches.

In examining the curves of FIGS. 6, 7, and 8, it is apparent that the sound absorption coefficient with each air chamber depth varies considerably with the frequency of the sound wave. Moreover, each of the curves, particularly if plotted over a wider range of frequencies than shown, have generally similar profiles. By increasing the depth of the air chamber, the response curve tends to be shifted to favor absorption of sound waves of lower frequency.

Figure 9:
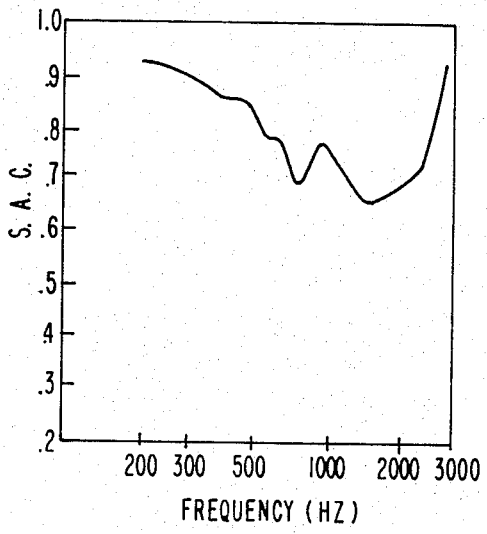

The fourth curve shown in FIG. 9 illustrates the effect obtained with a system including two porous metal sheets placed in parallel relationship to define air chambers of respectively 4-inch and 2-inch depths. The sound absorption coefficient of such a system has a more uniform sound absorption coefficient over a wider frequency range than is the case for any of the systems including a single air chamber. Where good sound absorption over a wide range of frequencies is desired, a system including two porous metal plates with two air chambers of different depths as illustrated in FIG. 4 constitutes a preferred embodiment of the invention.

The porous sheets of the invention can be used to absorb sound in many types of constructions beyond those illustrated in the drawings. To absorb sound waves in aircraft and ships, the porous sheets can be attached to the reinforcing ribs conventionally employed on the interior faces of the exterior skin of the aircraft or ship. Enclosures for air conditioners and like noisy machines can be fabricated which have porous metal sheets mounted on furring strips provided on the interior walls of the enclosures. Other means for using the porous sheets of the invention will be apparent to those skilled in the acoustical arts.

By reason of the large number of very small openings provided in the porous sheets of the invention, special fabrication methods are employed to prepare such sheets. One such technique is photo chemical machining. The general methods of using such techniques are described in the publications of the Photo Chemical Machining Institute of Evanston, Ill. (see publications PCMI-D-300 and PCMI-G-100). In an initial step, the metal sheet is coated with a light sensitive photographic emulsion which is resistant to a chemical that ultimately will be used to etch the openings in the metal sheet, this emulsion being referred to as a photoresist. The pattern of holes desired in the sheet is projected onto the photoresist by passing light through a suitable photographic positive or negative. The emulsion then is developed and the areas in the emulsion corresponding to the pores desired in the ultimate porous metal sheet are removed by a suitable solvent. The sheet then is etched chemically. Only the exposed sections of the sheet are etched to provide holes (pores) in the sheet. The other areas of the sheet are protected from the etching chemical by the photoresist.

While the processes and products herein described constitute preferred embodiments of the invention, it is to be understood that the invention is not limited to these precise processes and products, and that changes may be made therein without departing from the scope of the invention which is defined in the appended claims.

What is claimed is:

1. A sound absorbing article consisting essentially of:

(a) a planar, thin metal sheet about 3–15 mils thick containing therethrough at least about 400 openings per square inch, said openings having an average cross-sectional area of from about 0.0005 square inch to about 0.005 square inch, and said openings being distributed substantially uniformly over the sheet's entire surface, said sheet having an acoustical flow resistance in the range of about 10–300 rayls, and (b) a series of walls perpendicular to and supporting said metal sheet, said walls defining at least one air chamber having a depth of between about 1 to 12 inches on the underside of said metal sheet.

2. An article of claim 1 wherein at least about 90% of said openings having a cross-sectional area within about ±50% of said average cross-sectional area.

3. An article of claim 1 wherein said thin metal sheet has an acoustical resistance in the range of about 50–100 rayls.

4. An article of claim 1 wherein said thin metal sheet has an acoustical resistance in the range of about 50–100 rayls.

5. An article of claim 1 in which the air chambers have a depth of between about 2 and 6 inches.

6. An article of claim 1 wherein said openings are formed in said thin metal sheet by:

(a) projecting light upon a thin metal sheet coated with a light sensitive photoresist emulsion to provide exposed and unexposed areas, one of which corresponds to the openings desired in the ultimate metal sheet, (b) developing the exposed emulsion of step (a), (c) treating the developed emulsion of step (b) to remove therefrom only areas of the developed emulsion corresponding to the openings to be provided in the finished metal sheet, and (d) treating the metal sheet of step (c) with an etching chemical to contact and dissolve only the exposed areas of the metal sheet underlying the openings in the developed emulsion.

* * * * *